US006534453B2

(12) United States Patent
Omori et al.

(10) Patent No.: US 6,534,453 B2
(45) Date of Patent: Mar. 18, 2003

(54) LIGHT OIL COMPOSITION

(75) Inventors: Noriaki Omori, Saitama (JP); Kazuyoshi Namiyama, Saitama (JP)

(73) Assignee: ExxonMobil Research and Engineering Company, Annandale, NJ (US)

( * ) Notice: Subject to any disclaimer, the term of this patent is extended or adjusted under 35 U.S.C. 154(b) by 104 days.

(21) Appl. No.: 09/853,741

(22) Filed: May 11, 2001

(65) Prior Publication Data

US 2003/0029773 A1 Feb. 13, 2003

(51) Int. Cl.[7] ..... C10M 109/00; C10M 111/00

(52) U.S. Cl. ..... 508/465; 585/14; 44/300; 208/18; 208/19

(58) Field of Search ..... 508/465; 44/300; 208/18, 19; 585/465

(56) References Cited

U.S. PATENT DOCUMENTS

| | | | | |
|---|---|---|---|---|
| 3,928,173 A | * | 12/1975 | James | 208/78 |
| 5,015,404 A | * | 5/1991 | Kubo et al. | 208/19 |
| 5,362,375 A | * | 11/1994 | Kubo et al. | 208/19 |
| 6,215,034 B1 | * | 4/2001 | Oomori et al. | 585/14 |
| 6,264,827 B1 | * | 7/2001 | Okazaki et al. | 208/57 |

FOREIGN PATENT DOCUMENTS

| | | | |
|---|---|---|---|
| EP | 0608149 A1 | 7/1994 | |
| EP | 0680506 | 8/1994 | C10L/1/18 |

OTHER PUBLICATIONS

Derwent 2000–092787 (JP11335678) Showa Shell Sekiyu KK.
Derwent 1999–439873 (JP11181452) Cosmo Oil Co. Ltd.
Derwent 1996–306915 (JP08134476 Cosmo Oil Co. Ltd.
[a] Derwent 1994–236859 (EP–608149) Exxon Chem Patents Inc. (Equivalent).
H 11–335678, Japan (Kokai) (Derwent Abstract No. 2000–092787 [08]).
H 11–181452, Japan (Kokai) (Derwent Abstract No. 1999–439873 [37]).
H 08–134476, Japan (Kokai) (Derwent Abstract No. 1996–306915 [31]).
H 08–505893, Japan (Kohyo) (Derwent Abstract No. (*Equivalent).

* cited by examiner

*Primary Examiner*—Jacqueline V. Howard
(74) *Attorney, Agent, or Firm*—Linda M. Scuorzo

(57) ABSTRACT

The inventions relate to light oil compositions comprising a base oil, not less than 0.01% by volume of a light oil resulting from catalytic cracking and 20 to 200 ppm (on the weight basis) of a lubricity improver, with a total sulfur content of not more than 0.05% by weight, characterized in that the light oil resulting from catalytic cracking contains (1) not less than 25% by volume of bicyclic polycyclic aromatic compounds and (2) not less than 5% by volume of tricyclic polycyclic aromatic compounds. These compositions have a sulfur content of not more than 0.05% by weight and is excellent in lubricant performance.

4 Claims, 1 Drawing Sheet

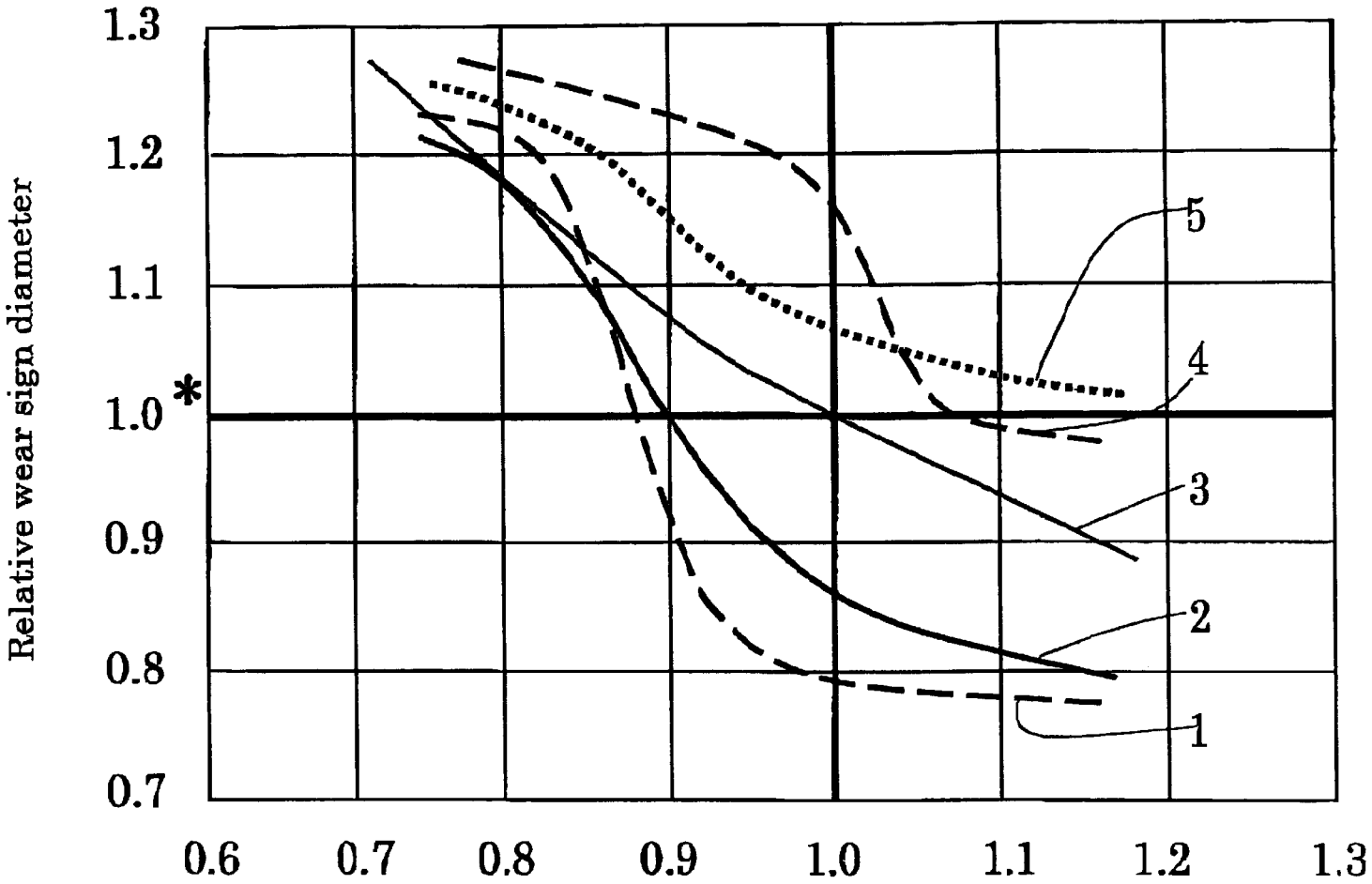
Relative addition level of the lubricity improve
*The wear sign diameter to be attained (reference wear sign diameter)

LIGHT OIL COMPOSITION

FIELD OF THE INVENTION

The present invention relates to a novel light oil (or gas oil) composition and, more particularly, to a light oil composition containing a catalytic cracking-derived light oil having a specific composition and a lubricity improver.

BACKGROUND OF THE INVENTION

Diesel engines are now widespread in society, mounted on automobiles, ships, construction equipment and the like. The number thereof tends to increase year by year. On the other hand, air pollution by hazardous exhaust gases has become an international problem from the environmental conservation viewpoint and, as regards the exhaust gases from diesel engines, which serve as one of the sources of air pollution, it is now a serious social need to reduce the emission of pollutants.

Endeavors have so far been made in various fields to reduce the contents of nitrogen oxides, particulate matter and like emission matter in the exhaust gases from diesel engines, for example improvements in combustion chamber morphology, provision of exhaust gas recirculating (EGR) systems, of catalyst systems for exhaust gas purification and of particulate matter collecting systems and improvements in the quality of light oils and diesel engine lubricants. The EGR systems, in which the exhaust gas from a diesel engine is circulated again as part of combustion air through the combustion chamber, are regarded as one of promising means. However, they have a number of problems, for example decreases in the durability and reliability of engines, deterioration of lubricants, increases in particulate matter emission and reductions of output as caused by sulfate ions, particulate matter and other substances occurring in exhaust gases. In particular when they are mounted on direct injection type diesel engines which are required to be operated under heavy loads, those problems become serious. Since the sulfate ion is derived from sulfur contained in light oil, such "reduction in the sulfur content in light oil" as to reduce the sulfur content to 0.05% by weight or below is demanded.

The sulfur content in light oil can be greatly reduced by base oil purification, in particular by catalytic hydrogenation. However, the reduction in sulfur content by such means simultaneously results in decomposition, change in quality or removal of those trace components which occur in the base oil and contribute to lubricant performance, with the result that the lubricant performance of the light oil becomes poor. Light oils with a low sulfur content thus have a problem in that they may cause damages to diesel engine injection pumps. In particular, it is known that when the sulfur content becomes lower than 0.2% by weight, the lubricant performance markedly lowers.

To solve such problems, attempts have so far been made which comprise adding lublicity improvers to low-sulfur light oils. For example, JP Kokai H08-134476 describes a low-sulfur light oil composition which comprises a low-sulfur light oil fraction and at least one additive selected from among diamine dicarboxylic acid salts, diamine monocarboxylic acid salts and monoamine carboxylic acid salts. JP Kohyo H08-505893 describes a fuel oil composition which comprises a low-sulfur liquid hydrocarbon medium quality fuel oil (e.g. diesel fuel) and an additive ester derived from a carboxylic acid containing 2 to 50 cabron atoms and an alcohol containing one or more carbon atoms (e.g. glycerol monooleate).

Further, JP Kokai H11-181452 discloses that a low-sulfur light oil composition which comprises a low-sulfur light oil comprising not less than 0.001% by volume of a straight light oil fraction obtained by atmospheric distillation of a crude oil, with 25 to 200 ppm by volume of a lubricity improver added, has good wear resistance. JP Kokai H11-335678 discloses a lubricant for low-sulfur light oils which comprises a polar fraction separated from a catalytic cracking-derived light oil and containing not less than 25% by volume of bicylcic and polycyclic aromatics as well as a low-sulfur light oil composition containing that lubricant as an additive, and mentions that such a low-sulfur light oil composition can show improved wear resistance without using any expensive lubricity improver.

However, these technologies all comprise incorporating an expensive lubricity improver or a special ingredient in low-sulfur light oils and their lubrication performance-improving effects are not yet satisfactory. Thus, for attaining a desired level of lubrication performance, it is necessary to add a large amount of such a lubricity improver or special ingredient. This produces the problem that the production cost of low-sulfur light oils rises.

SUMMARY OF THE INVENTION

An embodiment of the present invention provides a light oil composition having a sulfur content of not more than 0.05% by weight and showing a good lubrication performance at low cost.

The present inventors found that a light oil composition which contains a catalytic cracking-derived light oil containing a specific amount of bicyclic and tri- and polycyclic aromatic compounds can synergistically improve the performance characteristics of lubricity improvers, that, as a result, the level of addition of lubricity improvers can be markedly reduced and that low-sulfur light oils having good lubricant performance characteristics can therefore be produced economically at low cost. Based on such findings, they have now completed the present invention.

Thus, another embodiment of the present invention provides a light oil composition comprising a base oil, not less than 0.01% by volume of a light oil resulting from catalytic cracking and 20 to 200 ppm (on the weight basis) of a lubricity improver, with a total sulfur content of not more than 0.05% by weight, which is characterized in that the light oil resulting from catalytic cracking contains (1) not less than 25% by volume of one or more at least bicyclic polycyclic aromatic compounds and (2) not less than 5% by volume of one or more at least tricyclic polycyclic aromatic compounds.

Preferred embodiments of the present invention include the following:

(1) A light oil composition as mentioned above which contains the above-mentioned catalytic cracking-derived light oil in an amount of 0.05 to 2% by volume.

(2) A light oil composition as mentioned above or mentioned under (1) in which the above-mentioned catalytic cracking-derived light oil contains 30 to 50% by volume of bicyclic and tricyclic aromatic compounds.

(3) A light oil composition as mentioned above or mentioned under (1) or (2) in which the above-mentioned catalytic cracking-derived light oil contains 10 to 20% by volume of tricylic polycyclic aromatic compounds.

(4) A light oil composition as mentioned above or mentioned under any of (1) to (3) in which the above-mentioned lubricity improver is an ester compound.

(5) A light oil composition as mentioned above or mentioned under any of (1) to (4) in which the content of the above-mentioned lubricity improver is 40 to 160 ppm by weight.

(6) A light oil composition as mentioned above or mentioned under any of (1) to (4) in which the content of the above-mentioned lubricity improver is 60 to 120 ppm by weight.

The present invention may comprise, consist, consist essentially of the steps or elements recited herein and may be practiced in the absence of a step or element not recited, and includes the methods using the compositions to enhance lubricity in diesel engines.

BRIEF DESCRIPTION OF THE DRAWINGS

FIG. 1

FIG. 1 is a diagram showing the relations between the lubricity improver addition level and wear sign diameter for the light oil compositions of Example 1, Example 2 and Comparative Examples 1 to 3. Curve 1 shows the relation between the lubricity improver addition level and wear sign diameter for the light oil composition of Example 1. Curve 2 shows the relation between the lubricity improver addition level and wear sign diameter for the light oil composition of Example 2. Curve 3 shows the relation between the lubricity improver addition level and wear sign diameter for the light-oil composition of Comparative Example 1. Curve 4 shows the relation between the lubricity improver addition level and wear sign diameter for the light oil composition of Comparative Example 2. Curve 5 shows the relation between the lubricity improver addition level and wear sign diameter for the light oil composition of Comparative Example 3.

DETAILED DESCRIPTION OF THE PREFERRED EMBODIMENTS

An embodiment of the light oil composition of the invention comprises a light oil base oil and a catalytic cracking-derived light oil containing specific bicyclic and tricyclic aromatic compounds and a lubricity improver incorporated in that base oil and has a total sulfur content of not more than 0.05% by weight.

Light Oil Base Oil

The light oil base is not particularly restricted but may be any of those low-sulfur light oil base oils which are known in the art. For example, it is a light oil fraction mainly comprising a mineral oil and having a flash point of not lower than 40? and distillation characteristics such that the 90% distillation temperature is not higher than 360° C. and having a sulfur content of not more than 0.05% by weight, preferably not more than 0.04% by weight.

The sulfur content of the light oil base oil can be reduced by high-level desulfurization treatment in the process of its production. The extent of desulfurication can be established by appropriately controlling the desulfurization conditions so that the total sulfur content of the light oil composition of the invention may amount to not more than 0.05% by weight.

The mineral oil includes not only light oil fractions obtained by atmospheric distillation of a crude oil but also light oil fractions obtained from petroleum fractions obtained by atmospheric distillation or vacuum distillation of a crude oil by a combination of such treatments as hydrogenation purification, hydrocracking, catalytic cracking and solvent extraction. As other components than mineral oils, there may be mentioned, for example, vegetable oils such as soybean oil, coconut oil and rape seed oil and animal oils such as whale oil and fish oil. These light oil fractions may be used singly or in admixture.

Catalytic Cracking-Derived Light Oil

The light oil resulting from catalytic cracking, which is a constituent of the light oil composition is a light oil fraction obtained by catalytic cracking of a heavy oil, such as a desulfurized fraction from a residual oil obtained by atmospheric distillation of a crude oil, a heavy light oil fraction obtained from such atmospheric distillation residue by further vacuum distillation and desulfurization. It is not particularly restricted but may be any of those known in the art. According to the invention, however, it is important that the catalytic cracking-derived light oil contains not less than 15% by volume, preferably 30 to 50% by volume, of bicyclic aromatic compounds and not less than 5% by volume, preferably 10 to 20% by volume, of tricyclic aromatic compounds. When the content of bi-and tri-cyclic aromatic compounds is less than 25% by volume and/or the content of tricyclic aromatic compounds is less than 5% by volume, the synergistic improving effect on the performance characteristics of the lubricity improver is slight and, therefore, it becomes necessary to incorporate the lubricity improver in increased amounts so that the light oil composition may have the desired lubricant performance characteristics; this is uneconomical.

For any of the bicyclic or tricyclic polycyclic aromatic compounds, no upper content limit (subject to a total of 100% of all components) is defined. While the performance characteristics of the lubricity improver are improved as the content of the polycyclic aromatics increases, an excessively increased content thereof produces problems, namely it lowers the cetane value of the light oil composition and impairs the exhaust gas characteristics. In view of the operation conditions of catalytic cracking plants, the content of bicyclic and tricyclic aromatics is generally not more than 50% by volume. The content of tricyclic polycyclic aromatics is generally not more than 20% by volume in view of the fact that the catalytic cracking-derived light oil is a light oil fraction and generally has a boiling range of about 220 to 350° C. and anthracene and phenanthrene, which are tricyclic aromatics, have a boiling point around 340° C.

Although catalytic cracking-derived light oils generally have a sulfur content of 0.1 to 1.0% by weight, the sulfur content can be reduced by appropriate means of desulfurization, for example hydrodesulfurization. The extent of desulfirization can be set by appropriately controlling the desulfurization conditions so that the total sulfur content of the light oil composition may amount to not more than 0.05% by weight when the catalytic cracking-derived light oil is incorporated therein. The sulfur content after desulfurization treatment is generally 0.02 to 0.05% by weight.

The amount of the catalytic cracking-derived light oil to be incorporated in the light oil composition is not less than 0.01% by volume, preferably 0.05 to 2% by volume. At an addition level below 0.01% by volume, the effect of synergistically improving the performance of the lubricity improver is slight, hence it becomes necessary to incorporate the lubricity improver in increased amounts so that the light oil composition may show the desired level of lubricant performance. On the other hand, the upper limit to the content of the catalytic cracking-derived light oil is not particularly restricted. However, while the performance of the lubricity improver is synergistically improved as the content of thereof increases, an excessively high content thereof may produce problems, namely the cetane value of the light oil composition is lowered and the exhaust gas characteristics are worsened. Generally, the content thereof is not more than 2% by volume.

Lubricity Improver

The lubricity improver, which is a constituent of the light oil compositions is not particularly restricted but may be any of those known in the art. For example, mention may be made of fatty acid compounds such as stearic acid, linolic acid and oleic acid and ester compounds such as esters of fatty acids and poyhydric alcohols, typically the linolic acid ester of glycerol. Ester compounds are preferred, however. The level of addition of the lubricity improver is 20 to 200 ppm by weight, preferably 40 to 160 ppm by weight, more preferably 60 to 120 ppm by weight. Such lubricity improvers may be used singly or two or more of them may be used in admixture. At an addition level lower than 20 ppm, no substantital lubricity improving effect is obtained and, at a level exceeding 200 ppm by weight, the lubricity improving effect obtainable is no longer proportional to the addition level and such a level is uneconomical.

Light Oil Composition

The light oil composition comprises the light oil base oil mentioned above, the catalytic cracking-derived light oil and lubricity improver mentioned above as incorporated in that base oil, if desired, with another or other fuel oil additives incorporated therein. The method of preparing the light oil compositions is not particularly restricted but any of the light oil preparing methods known in the art may be employed.

The fuel oil additives optionally incorporated in the light oil compositions may be selected from among those known in the art within limits so that the performance of the light oil compositions may not be impaired. As such additives, there may be mentioned, for example, fluidity improvers, pour point depressants, cetane value improvers, antioxidants, metal deactivators, detergents, corrosion inhibitors, deicing agents, microbicides, combustion improvers, antistatic agents, colorants and the like. These additives may be used singly or two or more of them may be used in appropriate combination. The level of addition of these additives is, for example, in the case of the pour point depressants, but is not limited to, 0.1 to 0.5% by weight.

The fluidity improver includes polyethylene glycol ester compounds, ethylene-vinyl acetate copolymers, ethylene-alkyl acrylate copolymers, chlorinated polyethylenes, polyalkyl acrylates and alkenylsuccinamide compounds, among others.

Further, when desirable, the light oil compositions may contain an oxygen-containing compound. For example, there may be mentioned aliphatic alcohols such as methanol, ethanol, isopropanol, n-butanol, isobutanol, tert-butanol, amyl alcohol, isoamyl alcohol, n-octanol, 2-ethylhexanol, n-heptyl alcohol, tridecyl alcohol, cyclohexanol and methylcyclohexanol, ethers such as methyl tert-butyl ether and ethyl tert-butyl ether, dialkyl phthalate compounds such as diethyl phthalate, dipropyl phthalate and dibutyl phthalate, glycol ether compounds such as ethylene glycol monoisobutyl ether, diethylene glycol mono-n-butyl ether, diethylene glycol monoisobutyl ether, diethylene glycol dimethyl ether, triethyleneglycol mono-n-butyl ether, triethylene glycol dimethyl ether, propylene glycol, propylene glycol monomethyl ether acetate and dipropylene glycol mono-n-butyl ether, hydroxylamine compounds, and diketone compounds such as acetylacetone, among others. The level of addition of the oxygen-containing compound is, but is not limited to, 1 to 15% by weight.

EXAMPLES

The following examples illustrate the present invention in further detail. They are, however, by no means limitative of the scope of the invention. In the following working examples and comparative examples, the base light oil, catalytic cracking-derived light oils and lubricity improver specified below were used.

(1) Base Light Oil

A light oil fraction obtained by atmospheric distillation of a Middle East crude oil was subjected to hydrodesulfurization and the product obtained was used as the base light oil. General characteristics of the base light oil used in the examples and comparative examples are shown in Table 1. The content of bicyclic and tricyclic aromatic compounds and the content of tricyclic aromatic compounds were determined by HPLC method (high pressure liquid chromatagraphy) recommended by the Japan Petroleum Industry Society (JPI-5S-49-97).

TABLE 1

| | | Catalytic Cracking-Derived Light Oil | |
|---|---|---|---|
| | Base Light Oil | A | B |
| General Characteristics | | | |
| Density, g/cm$^3$ | 0.842 | 0.917 | 0.863 |
| Distillation Range, ° C. | | | |
| Initial Boiling Point | 214 | 183 | 135 |
| 10% | 251 | 240 | 180 |
| 50% | 285 | 282 | 204 |
| 90% | 324 | 331 | 225 |
| End Point | 343 | 349 | 242 |
| Sulfur Content, wt % | 0.035 | 0.4 | 0.15 |
| Polycyclic Aromatics, vol. % | | | |
| At least bicyclic | 3 | 40 | 10 |
| At least tricyclic | 0.5 | 15 | 0.1 |

(2) Catalytic Cracking-Derived Light Oils

A catalytic cracking-derived light oil fraction was obtained by subjecting a vacuum-distilled light oil to fluidized catalytic cracking and then subjected to hydrodesulfurization to give a catalytic cracking-derived light oil (A). Separately, a light catalytic cracking-derived light oil fraction was obtained by fluidized catalytic cracking of a vacuum-distilled light oil while adjusting the operation conditions of the catalytic cracking plant and then subjected to hydrodesulfurization to give a catalytic cracking-derived light oil (B). General characteristics of the catalytic cracking-derived light oils A and B used are shown in Table 1. The contents of bicyclic and tricyclic aromatic compounds were determined by the method mentioned above.

(3) Lubricity Improver

A commercially available ester compound-based lubricity improver (PDN 655 -product of Infineum) was used.

EXAMPLE 1

To the base light oil was added 1.0% by volume of the catalytic cracking-derived light oil A. Then, three light oil compositions, (1) to (3), were prepared by incorporating therein the lubricity improver (PDN 655) at levels of about 85, about 105 and about 120 ppm by weight based on the total weight of the resulting light oil compositions. For the light oil composition (1) among the light oil compositions (1) to (3), the formulation, the addition level of the lubricity improver and typical general characteristics are shown in Table 2. The lubricity testing method was as described below.

TABLE 2

| | Example 1 Light oil Composition (1) | Example 2 Light Oil Composition (4) |
|---|---|---|
| Formulation, vol. % | | |
| Base Light Oil | 99.0 | 99.9 |
| Catalytic cracking-derived light oil A | 1.0 | 0.1 |
| Catalytic cracking-derived light oil B | ° C. | ° C. |
| (Total) | (100) | (100) |
| Lubricity Improver | 85(0.78) | 85(0.78) |
| General Characteristics | | |
| Density, g/cm$^3$ | 0.843 | 0.842 |
| Distillation Range, 1° C. | | |
| Initial Boiling Point | 220 | 218 |
| 10% | 251 | 251 |
| 50% | 285 | 284 |
| 90% | 322 | 323 |
| End Point | 344 | 343 |
| Sulfur Content, wt % | 0.039 | 0.036 |
| Polycyclic Aromatics, vol. % | | |
| At least bicyclic | 3.4 | 3.0 |
| At least tricyclic | 0.7 | 0.5 |

*The value in ( ) is the relative addition level with the addition level of the lubricity improver as required to attain the wear sign diameter aimed at (reference wear sign diameter = 1.0) in Comparative Example 1 being taken as 1.0.

Lubricity Testing Method

The light oil composition was tested for lubricant performance according to JPI-5S-50-98 (light oil lubricity testing method). The wear sign diameter (WSD) (° Cm,) was measured under the test conditions shown in Table 3 using a HFRR (high frequency reciprocating rig) tester (product of PCS). The wear sign diameter was calculated as (major axis of wear sign+minor axis of wear sign)/2. Each value shown is a mean of values obtained in several repetitions of the test. A light oil composition superior in lubricant performance gives a small wear sign diameter while a light composition inferior in lubricant performance gives a large wear sign diameter.

TABLE 3

| | |
|---|---|
| Liquid Volume | 2 ± 0.20 ml |
| Stroke | 1 ± 0.03 mm |
| Frequency | 50 ± 1 Hz |
| Liquid Temperature | 60 ± 2° |
| Load | 200 ± 1 gf |
| Testing Time | 75 ± 0.1 min. |
| Liquid Surface Area | 6 ± 1 cm$^2$ |

Then, the three light oil compositions were subjected to lubricity testing and the wear sign diameters were measured. The relationship thus found between the addition level of the lubricity improver and the wear sign diameter is shown in FIG. 1 as curve 1. In FIG. 1, the ordinate denotes the wear sign diameter as expressed in terms of relative wear sign diameter with the wear sign diameter aimed at (reference wear sign diameter) being taken as 1.0. The abscissa denotes the level of addition of the lubricity improver as expressed in terms of relative addition level with the level of addition (reference addition level) of the lubricity improver as required to attain the reference wear sign diameter (1.0) in Comparative Example 1 (to be mentioned later herein) being taken as 1.0. From curve 1 in FIG. 1, the relative addition level (0.87) of the lubricity improver as required to attain the reference wear sign diameter (1.0) was determined. This is shown in Table 4.

TABLE 4

| Lubricity Testing of Light Oil | Example | | Compar. Example | | |
|---|---|---|---|---|---|
| Compositions | 1 | 2 | 1 | 2 | 3 |
| (1) Reference wear sign diameter | 1.0 | 1.0 | 1.0 | 1.0 | 1.0 |
| (2) Relative lubricity improver addition level required to attain (1) | 0.87 | 0.90 | 1.00 | 1.07 | 1.10+ |

EXAMPLE 2

Three light oil compositions, (4) to (6), differing in lubricity improver addition level were prepared in the same manner as in Example 1 except that the catalytic cracking-derived light oil A was incorporated in an amount of 0.1% by volume. For the light oil composition (4) among the light oil compositions (4) to (6), the formulation, the addition level of the lubricity improver and typical general characteristics are shown in Table 2. Then, the three light oil compositions were subjected to lubricity testing and the wear sign diameters were measured. The relationship thus found between the addition level of the lubricity improver and the wear sign diameter is shown in FIG. 1 as curve 2. From curve 2 in FIG. 1, the relative addition level (0.90) of the lubricity improver as required to attain the reference wear sign diameter (1.0) was determined. This is shown in Table 4.

COMPARATIVE EXAMPLE 1

Three light oil compositions, (7) to (9), differing in lubricity improver addition level were prepared in the same manner as in Example 1 except that the catalytic cracking-derived light oil A was not used. For the light oil composition (7) among the light oil compositions (7) to (9), the formulation, the addition level of the lubricity improver and typical general characteristics are shown in Table 5. Then, the three light oil compositions were subjected to lubricity testing and the wear sign diameters were measured. The relationship thus found between the addition level of the lubricity improver and the wear sign diameter is shown in FIG. 1 as curve 3. For the light oil composition of Comparative Example 1, the relative addition level of the lubricity improver as required to attain the reference wear sign diameter (1.0) was 1.00, as mentioned above. This is shown in Table 4.

TABLE 5

| | Compar. Ex. 1 Light oil compn.(7) | Compar. Ex. 2 Light oil compn. (10) | Compar. Ex. 3 Light oil compn. (13) |
|---|---|---|---|
| Formulation, vol. % | | | |
| Base light oil | 100 | 99.0 | 99.9 |
| Catalytic cracking-derived light oil A | ° C. | ° C. | ° C. |
| Catalytic cracking-derived light oil B | ° C. | 1.0 | 0.1 |
| (Total) | (100) | (100) | (100) |
| Lubricity improver,* wt ppm | 85(0.78) | 85(0.78) | 85(0.78) |
| General characteristics | | | |
| Density, g/cm$^3$ | 0.842 | 0.843 | 0.842 |
| Distillation range, ° C. | | | |
| Initial boiling point | 214 | 217 | 216 |
| 10% | 251 | 250 | 251 |
| 50% | 285 | 284 | 285 |
| 90% | 324 | 322 | 323 |

TABLE 5-continued

| | Compar. Ex. 1 Light oil compn.(7) | Compar. Ex. 2 Light oil compn. (10) | Compar. Ex. 3 Light oil compn. (13) |
|---|---|---|---|
| End point | 343 | 342 | 343 |
| Sulfur content, wt % | 0.035 | 0.037 | 0.035 |
| Polycyclic aromatics, vol. % | | | |
| At least bicyclic | 3 | 3.1 | 3.0 |
| At least tricyclic | 0.5 | 0.5 | 0.5 |

*Each value in ( ) is the relative addition level with the addition level of the lubricity improver as required to attain the wear sign diameter aimed at (reference wear sign diameter = 1.0) in Comparative Example 1 being taken as 1.0.

COMPARATIVE EXAMPLE 2

Three light oil compositions, (10) to (12), differing in lubricity improver addition level were prepared in the same manner as in Example 1 except that 1.0% by volume of the catalytic cracking-derived light oil B was incorporated in lieu of the catalytic cracking-derived light oil A. For the light oil composition (10) among the light oil compositions (10) to (12), the formulation, the addition level of the lubricity improver and typical general characteristics are shown in Table 5. Then, the three light oil compositions were subjected to lubricity testing and the wear sign diameters were measured. The relationship thus found between the addition level of the lubricity improver and the wear sign diameter is shown in FIG. 1 as curve 4. From curve 4 in FIG. 1, the relative addition level (1.07) of the lubricity improver as required to attain the reference wear sign diameter (1.0) was determined. This is shown in Table 4.

COMPARATIVE EXAMPLE 3

Three light oil compositions, (13) to (15), differing in lubricity improver addition level were prepared in the same manner as in Example 1 except that 0.1% by volume of the catalytic cracking-derived light oil B was incorporated in lieu of the catalytic cracking-derived light oil A. For the light oil composition (13) among the light oil compositions (13) to (15), the formulation, the addition level of the lubricity improver and typical general characteristics are shown in Table 5. Then, the three light oil compositions were subjected to lubricity testing and the wear sign diameters were measured. The relationship thus found between the addition level of the lubricity improver and the wear sign diameter is shown in FIG. 1 as curve 5. From curve 5 in FIG. 1, the relative addition level (not less than 1.10) of the lubricity improver as required to attain the reference wear sign diameter (1.0) was determined. This is shown in Table 4.

As is evident from the results shown in FIG. 1, curve 1 and in Table 4, the light oil composition of Example 1 showed significant decreases in relative wear sign diameter with the increasing addition level of the lubricity improver and the relative addition level of the lubricity improver as required to attain the wear sign diameter aimed at (reference wear sign diameter=1.0) was 0.87. Similarly, the relative addition level in the light oil composition of Example 2 was 0.90, as the results shown as curve 2 and in Table 4 indicate. On the contrary, the light oil compositions of Comparative Examples 1 to 3 all required lubricity improver addition levels of 1.0, namely the same as the conventional level, or higher to attain the wear sign diameter aimed at (reference wear sign diameter=1.0), as the results shown as curves 3 to 5 and in Table 4 indicate, although the wear sign diameter decreased with the increase in lubricity improver addition level in each composition. In the case of the light oil composition of Comparative Example 3, the wear sign diameter aimed at (reference wear sign diameter=1.0) could not be attained even when the relative addition level was increased.

Thus, with the light oil compositions of Examples 1 and 2 according to the invention, the relative addition level of the lubricity improver as required to attain the wear sign diameter aimed at (reference wear sign diameter=1.0) could be reduced to 0.87 to 0.90 from the prior art level, namely 1.0, by about 10% or more as compared with the light oil compositions of Comparative Examples 1 to 3.

As described hereinabove in detail and specifically, the light oil composition according to the invention which comprises a base oil, not less than 0.01% by volume of a light oil resulting from catalytic cracking and 20 to 200 ppm (on the weight basis) of a lubricity improver, with a total sulfur content of not more than 0.05% by weight and is characterized in that the light oil resulting from catalytic cracking contains (1) not less than 25% by volume of one or more at least bicyclic polycyclic aromatic compounds and (2) not less than 5% by volume of one or more at least tricyclic polycyclic aromatic compounds shows excellent lubricant performance characteristics and, as a result, can reduce the lubricity improver addition level and, therefore, the invention is effective in producing light oil compositions excellent in lubricant performance at low cost. It can also be expected that catalytic cracking-derived light oils might be used as base light oils.

What is claimed is:

1. A light oil composition, comprising: a base oil, not less than 0.01% by volume of a light oil resulting from catalytic cracking and 20 to 200 ppm (on the weight basis) of a lubricity improver, with a total sulfur content of not more than 0.05% by weight, characterized in that said light oil resulting from catalytic cracking contains (1) not less than 25% by volume of one or more of bicyclic aromatic compounds and (2) not less than 5% by volume of one or more tricyclic aromatic compounds.

2. The composition of claim 1 wherein the light oil, resulting from catalytic cracking, is from 0.05 to 20% by volume.

3. The composition of claim 1 wherein the light oil contains 30 to 50% by volume of bi-and tricyclic aromatic compounds.

4. A method of improving the lubricity of a diesel engine by adding thereto a lubricity-enhancing amount of a light oil composition, comprising: a base oil, not less than 0.01% by volume of a light oil resulting from catalytic cracking and 20 to 200 ppm (on the weight basis) of a lubricity improver, with a total sulfur content of not more than 0.05% by weight, characterized in that said light oil resulting from catalytic cracking contains (1) not less than 25% by volume of one or more of bicyclic aromatic compounds and (2) not less than 5% by volume of one or more tricyclic aromatic compounds.

* * * * *